US008803749B2

(12) United States Patent
Leung et al.

(10) Patent No.: US 8,803,749 B2
(45) Date of Patent: Aug. 12, 2014

(54) ELLIPTICALLY OR CIRCULARLY POLARIZED DIELECTRIC BLOCK ANTENNA

(76) Inventors: Kwok Wa Leung, Shatin (HK); Yong Mei Pan, Shatin (HK); Kai Lu, Hong Kong (HK)

( * ) Notice: Subject to any disclaimer, the term of this patent is extended or adjusted under 35 U.S.C. 154(b) by 462 days.

(21) Appl. No.: 13/071,714

(22) Filed: Mar. 25, 2011

(65) Prior Publication Data

US 2012/0242553 A1 Sep. 27, 2012

(51) Int. Cl.
*H01Q 19/09* (2006.01)

(52) U.S. Cl.
USPC ..... 343/756

(58) Field of Classification Search
USPC ..... 343/756
See application file for complete search history.

(56) References Cited

U.S. PATENT DOCUMENTS

| | | | | |
|---|---|---|---|---|
| 2,624,003 | A | | 12/1952 | Iams |
| 2,953,786 | A | | 9/1960 | Krause |
| 3,188,643 | A | | 6/1965 | Dyson et al. |
| 3,474,452 | A | | 10/1969 | Bogner |
| 3,641,578 | A | | 2/1972 | Spanos et al. |
| 3,656,166 | A | | 4/1972 | Klopach et al. |
| 3,665,478 | A | | 5/1972 | Dempsey |
| 3,725,943 | A | | 4/1973 | Spanos |
| 3,740,754 | A | | 6/1973 | Epis |
| 3,742,510 | A | | 6/1973 | Spanos |
| 3,771,162 | A | | 11/1973 | Dienes |
| 3,805,266 | A | | 4/1974 | Fletcher et al. |
| 3,943,522 | A | | 3/1976 | Ben-Dov |
| 4,008,479 | A | | 2/1977 | Smith |
| 4,021,815 | A | | 5/1977 | Bogner |
| 4,054,877 | A | | 10/1977 | Bogner et al. |
| 4,063,245 | A | | 12/1977 | James et al. |
| 4,109,255 | A | | 8/1978 | Silliman |
| 4,203,118 | A | | 5/1980 | Alford |
| 4,218,685 | A | | 8/1980 | Ellis, Jr. |
| 4,527,163 | A | | 7/1985 | Stanton |
| 4,568,943 | A | * | 2/1986 | Bowman ..... 343/756 |
| 4,599,623 | A | | 7/1986 | Havkin et al. |
| 4,751,512 | A | | 6/1988 | Longaker |
| 4,864,320 | A | | 9/1989 | Munson |
| 4,903,033 | A | | 2/1990 | Tsao et al. |
| 4,958,162 | A | | 9/1990 | Roberts et al. |

(Continued)

FOREIGN PATENT DOCUMENTS

| | | | |
|---|---|---|---|
| CA | 809812 | A | 4/1968 |
| CN | 101719599 | A | 6/2010 |

(Continued)

*Primary Examiner* — Allyson Trail
(74) *Attorney, Agent, or Firm* — Renner Kenner Greive Bobak Taylor & Weber

(57) ABSTRACT

An elliptically polarized (EP) dielectric block antenna comprises a linearly polarized (LP) dielectric block antenna and a wave polarizer integrated with the LP dielectric block antenna. The wave polarizer converts the LP wave of the LP dielectric block antenna into an EP wave or a circularly polarized (CP) wave. The wave polarizer is directly integrated with the LP dielectric block antenna by fabricating inclined slots on faces of the dielectric block at an oblique angle to the LP wave direction of polarization. This provides a very compact EP or CP antenna with a broadside or omnidirectional radiation pattern. The EP or CP antenna is excited by an inner conductor of a SubMiniature version A (SMA) connector that can be directly connected to a coaxial line thereby providing a simple feed network for the antenna.

14 Claims, 8 Drawing Sheets

(56) References Cited

U.S. PATENT DOCUMENTS

| | | | | |
|---|---|---|---|---|
| 4,980,693 | A | 12/1990 | Wong et al. | |
| 5,517,203 | A | 5/1996 | Fiedziuszko | |
| 5,596,338 | A | 1/1997 | Smith | |
| 5,886,667 | A | 3/1999 | Bondyopadhayay | |
| 5,940,036 | A | 8/1999 | Oliver et al. | |
| 6,127,976 | A | 10/2000 | Boyd et al. | |
| 6,147,647 | A | 11/2000 | Tassoudji et al. | |
| 6,198,451 | B1 * | 3/2001 | Aylward et al. | 343/756 |
| 6,201,510 | B1 | 3/2001 | Lopez et al. | |
| 6,342,867 | B1 | 1/2002 | Bell | |
| 6,618,016 | B1 | 9/2003 | Hannan et al. | |
| 6,816,127 | B2 | 11/2004 | McKivergan et al. | |
| 6,906,683 | B2 | 6/2005 | Ikeda et al. | |
| 7,064,714 | B2 | 6/2006 | LaFleur | |
| 7,091,917 | B2 | 8/2006 | Jan et al. | |
| 7,119,757 | B1 | 10/2006 | Lopez | |
| 7,541,998 | B1 | 6/2009 | Chang et al. | |
| 7,649,505 | B2 | 1/2010 | Schadler | |
| 7,782,266 | B2 | 8/2010 | Chang et al. | |
| 2002/0000935 | A1 * | 1/2002 | Lahti | 343/700 MS |
| 2003/0197651 | A1 * | 10/2003 | Yuanzhu | 343/725 |
| 2005/0062661 | A1 | 3/2005 | Zagiiloul et al. | |
| 2007/0254587 | A1 | 11/2007 | Schadler et al. | |
| 2008/0002652 | A1 | 1/2008 | Gupta et al. | |
| 2008/0309562 | A1 | 12/2008 | Tsutsumi et al. | |
| 2009/0073072 | A1 | 3/2009 | Lindenmeier et al. | |
| 2009/0102724 | A1 | 4/2009 | Tsutsumi | |
| 2009/0156118 | A1 * | 6/2009 | Schadler | 455/25 |
| 2010/0053006 | A1 | 3/2010 | Miyoshi et al. | |
| 2010/0109960 | A1 | 5/2010 | Guler et al. | |

FOREIGN PATENT DOCUMENTS

| | | | |
|---|---|---|---|
| DE | 20314442 | U1 | 11/2003 |
| EP | 0463263 | B1 | 4/1994 |
| GB | 804518 | A | 11/1958 |
| GB | 805478 | A | 12/1958 |
| JP | 53093757 | A | 8/1978 |
| JP | 1282138 | C | 9/1985 |
| JP | 63048003 | A1 | 2/1988 |
| JP | 1051805 | A | 2/1989 |
| JP | 2224408 | A | 9/1990 |
| JP | 4150503 | A | 5/1992 |
| JP | 4344705 | A | 12/1992 |
| JP | 5183329 | A | 7/1993 |
| JP | 6225226 | C | 11/1993 |
| JP | 7112131 | B | 11/1995 |
| JP | 2023748 | C | 2/1996 |
| JP | 2526673 | B2 | 8/1996 |
| JP | 8237025 | A | 9/1996 |
| JP | 2108648 | C | 11/1996 |
| JP | 9008539 | A | 1/1997 |
| JP | 2599430 | B2 | 4/1997 |
| JP | 9232835 | A | 9/1997 |
| JP | 2824505 | B2 | 11/1998 |
| JP | 2001068924 | A | 3/2001 |
| JP | 2002353727 | A | 12/2002 |
| JP | 2003110355 | A | 4/2003 |
| JP | 20066270602 | A | 10/2006 |
| JP | 2009111510 | A | 5/2009 |
| JP | 4278534 | B2 | 6/2009 |
| JP | 4344975 | B2 | 10/2009 |
| JP | 2009225068 | A | 10/2009 |
| JP | 4383814 | B2 | 12/2009 |
| KR | 20010037645 | A | 5/2001 |
| KR | 100588765 | B1 | 6/2006 |
| MX | 03010485 | A | 12/2004 |
| TW | 518800 | B | 1/2003 |
| WO | 8807269 | A1 | 9/1988 |
| WO | 2000014561 | A1 | 3/2000 |
| WO | 03019718 | A1 | 3/2003 |

* cited by examiner

ELLIPTICALLY OR CIRCULARLY POLARIZED DIELECTRIC BLOCK ANTENNA

FIELD OF THE INVENTION

The invention generally relates to an elliptically polarized (EP) dielectric block antenna and, more particularly, to a circularly polarized (CP) dielectric block antenna having a broadside or omnidirectional radiation pattern.

BACKGROUND OF THE INVENTION

In general, a linearly polarized (LP) wave can be changed into an elliptically (EP) polarized or circularly polarized (CP) wave by using a wave polarizer. Therefore, it is theoretically possible to obtain an EP or CP antenna by adding a wave polarizer to an LP antenna. However, adding an external polarizer inevitably increases the size and complexity of the resulting antenna which is not desirable.

M. Ikeda, H. Nakano, "Antenna for receiving circularly polarized wave," JP3848603 (B2), 22 Nov. 2006 discloses an antenna for receiving circularly polarized waves. The antenna comprises a monopole antenna having a pole part and an earth plate for grounding one terminal of the pole part, and a polarization conversion means arranged around the monopole antenna. The polarization conversion means consists of a plurality of helical conductors which are spaced from the pole part by a prescribed distance and are helically wound around the pole part and have one end grounded to the earth plate. The helical conductors are arranged around the pole part at uniform angular intervals. This is a complex structure to manufacture.

J. L. Schadler, "Circularly polarized low wind load omnidirectional antenna apparatus and method," U.S. Pat. No. 7,649,505 (B2), 19 Jan. 2010 discloses a circularly polarized, omnidirectional, corporate-feed pylon antenna using multiple helically-oriented dipoles in each bay, and including a vertical and diagonal support arrangement of simple structural shapes configured to provide a frame strong enough to sustain mechanical top loads applied externally. The radiators in each bay fit within the vertical supports. The radiators are integrally formed with cross-braces, and are fed with manifold feed straps incorporating tuning paddles. A single cylindrical radome surrounds the radiative parts and the vertical supports. This is also a complex structure to manufacture.

M. Takahashi, "Antenna," JP9232835 (A), 5 Sep. 1997 discloses an antenna structure for a mobile telephone radio communication system base station. The antenna has an outer sheath on a surface of a support pole. Slots corresponding to the operating frequency of the radio communication system are made in the outer sheath and act like a radio wave radiation means. The support pole and the outer sheath are energized by a feeding means from the base station. The radio wave from the base station is radiated uniformly from the slots formed in the outer sheath. This antenna structure is limited to large size antennas for base stations or the like.

None of the three foregoing antenna structures employs a dielectric resonator or dielectric block.

T. H. Chang, J. F. Kiang, "Circularly-polarized dielectric resonator antenna," U.S. Pat. No. 7,541,998 (B1), 2 Jun. 2009 discloses a circularly-polarized dielectric resonator antenna (DRA). The antenna comprises a substrate, a Wilkinson power divider, a phase shifter, a ground plane and a dielectric resonator, wherein the phase shifter is connected to the Wilkinson power divider. The dielectric resonator is disposed on the ground plane, and includes a dielectric main body and a slot disposed above the substrate. Additionally, the antenna is adopted to increase the linear radiation bandwidth by utilizing the slot, and transceives a circularly-polarized electromagnetic wave by utilizing the Wilkinson power divider.

M. B. Oliver, Y. M. M. Antar, "Broadband circularly polarized dielectric resonator antenna," U.S. Pat. No. 5,940,036 (A), 17 Aug. 1999 discloses a radiating antenna capable of generating or receiving circularly polarized radiation using a single feed and a dielectric resonator. The dielectric resonator has slightly differing dimensions along two axes. Substantially polarized radiation can be generated in each of two mutually orthogonal modes by placement of the probe at each of two locations. When the feed is situated substantially between these two locations, two orthogonal modes are excited simultaneously.

C. H. Tsao, Y. Hwang, F. J. Kilburg, F. J. Dietrich, "Planar dual polarization antenna," U.S. Pat. No. 4,903,033 (A), 20 Feb. 1990 discloses a microwave-frequency microstrip antenna simultaneously usable for both transmitting and receiving microwave-frequency signals that have dual orthogonally polarized components. The components may be either linearly or circularly polarized. A radiating patch is mounted on a first dielectric. A ground plane abuts the first dielectric and has two elongated coupling apertures at right angles to each other. A second dielectric abuts the ground plane and has embedded thereon two substantially identical conductive planar feed networks that are disposed at right angles to each other. At least one additional optional dielectric layer having a conductive patch may be interposed between the first dielectric and the ground plane for purposes of broadening the bandwidth of the antenna. A meanderline polarizer or a 3 dB 90 DEG hybrid coupler may be used for converting from linear polarization to circular polarization.

T. M. Smith, "Multifunction antenna assembly with radiating horns," U.S. Pat. No. 5,596,338, 21 Jan. 1997 discloses an assembly of antenna elements mounted in a unitary structure for transport on a satellite encircling the earth. Each element comprises a horn shaped radiator with opposed arcuate sidewalls, a rectangular waveguide feed, and a transition interconnecting the feed to a throat of the horn. The assembly services a plurality of portions of a communication band within the electromagnetic spectrum. The throats of respective horns are dimensioned for specific frequencies of the respective portions of the communication bands. The antenna elements may provide telemetry and control functions for the satellite. A side-by-side arrangement of the horns permits use of a common meanderline polarizer for conversion of a linearly polarized wave to a circularly polarized wave for each antenna element.

Of the latter four references, U.S. Pat. No. 7,541,998 and U.S. Pat. No. 5,940,036 utilize dielectric elements, but they can generate broadside radiation only, whereas U.S. Pat. No. 4,903,033 and U.S. Pat. No. 5,596,338 put an external polarizer around an LP antenna to achieve the CP radiation, at the cost of substantially increasing the overall antenna size.

References considered to be of technological background interest to the subject matter of the present invention include: "Antenna device," JP2010056828 (A), 11 Mar. 2010; J. L. Schadler, "Circularly polarized omnidirectional in-building signal booster apparatus and method," US2009156118 (A1), 18 Jun. 2009; K. Tamakuma, M. Ashizawa, "Omnidirectional antenna for RFID," JP2009111510 (A), 21 May. 2009; J. L. Schadler, "Circularly polarized low wind load omnidirectional antenna apparatus and method," U.S. Pat. No. 7,649,505 (B2), 19 Jan. 2010; J. L. Schadler, A. Skalina, "Antenna system and method to transmit crosspolarized signals from a common radiator with low mutual coupling," US2007254587

(A1), 11 Jan. 2007; A. R. Lopez, "Dual-array two-port differential GPS antenna systems," U.S. Pat. No. 7,119,757 (B1), 10 Oct. 2006; K. K. Bell, "Embedded turnstile antenna," RU2258286 (C2), 10 Aug. 2005; P. W. Hannan, A. R. Lopez, "Eight-element anti-jam aircraft GPS antennas," U.S. Pat. No. 6,618,016 (B1), 9 Sep. 2003; T. Yasuda, "Broadband omnidirectional circularly polarized wave antenna," JP4344975 (B2), 14 Oct. 2009; R. W. Boyd, D. J. Stryker, "Network for multi-lateration with circularly polarized antenna," WO0014561 (A1), 16 Mar. 2000; R. W. Boyd, D. J. Stryke, "Distributed network for multi-lateration with circularly polarized antenna for hemispherical coverage," U.S. Pat. No. 6,127,976 (A), 3 Oct. 2000; A. R. Lopez, R. J. Kumpfbeck, "Self-contained progressive-phase GPS elements and antennas," U.S. Pat. No. 6,201,510 (B1), 13 Mar. 2001; P. K. Bondyopadhayay, "Integrated microstrip helmet antenna system," U.S. Pat. No. 5,886,667 (A), 23 Mar. 1999; H. Ishimaru, "Omnidirectional antenna," JP4344705 (A), 1 Dec. 1992; J. Bourdier, "Circularly-polarized omnidirectionnal antenna with maximum horizontal gain," EP0463263 (B1), 13 Apr. 1994; A. Kuramoto, "Circularly polarized wave antenna," JP2526673 (B2), 21 Aug., 1996; D. B. Hurt, "Omnidirectional antenna system," WO8807269 (A1), 22 Sep. 1988; P. H. Stanton, "Omnidirectional, circularly polarized, cylindrical microstrip antenna," U.S. Pat. No. 4,527,163 (A), 2 Jul. 1985; A. Alford, "Antenna for cross polarized waves," U.S. Pat. No. 4,203,118 (A), 13 May. 1980; T. B. Silliman, "Omnidirectional broadband circularly polarized antenna," U.S. Pat. No. 4,109,255 (A), 22 Aug. 1978; M. Takahashi, "Circularly polarized wave generator," JP53093757 (A), 17 Aug. 1978; V. C. Smith, "Dual-frequency circularly polarized antenna for satellite navigation and related problems," CA1057392 (A1), 26 Jun. 1979; R. D. Bogner, "Circularly polarized transmitting antenna employing end-fire elements," U.S. Pat. No. 4,021,815 (A), 3 May. 1977; R. D. Bogner, L. H. King, "Circularly polarized dipole type omnidirectional transmitting antenna," U.S. Pat. No. 4,054,877 (A), 18 Oct. 1977; O. Ben-Dov, "Circularly polarized antenna system using a combination of turnstile and vertical dipole radiators," U.S. Pat. No. 3,943,522 (A), 9 Mar. 1976; J. Fletcher J, R. Munson, "Turnstile slot antenna," U.S. Pat. No. 3,805,266 (A), 16 Apr. 1974; "Multimode antenna," GB1338753 (A), 28 Nov. 1973; G. Dienes, "Omnidirectional antenna," U.S. Pat. No. 3,771,162 (A), 6 Nov. 1973; W. Spanos, "Turnstile antenna," U.S. Pat. No. 3,725,943 (A), 3 Apr. 1973; W. M. Spanos, M. S. Polgar, "Discone antenna," U.S. Pat. No. 3,641,578 (A), 8 Feb. 1972; R. T. Klopach, J. Bohar, "Broadband circularly polarized omnidirectional antenna," U.S. Pat. No. 3,656,166 (A), 11 Apr. 1972; R. D. Bogner, "Omnidirectional circularly polarized antenna," U.S. Pat. No. 3,474,452 (A), 21 Oct. 1969; J. D. Dyson, P. E. Mayes, "Circularly polarized omnidirectional cone mounted spiral antenna," U.S. Pat. No. 3,188,643 (A), 8 Jun. 1965; "Improvements in or relating to antenna structure," GB924145 (A), 24 Apr. 1963; "Omnidirectional antenna," GB805478 (A), 10 Dec. 1958; R. D. Bogner, "Omnidirectional circularly polarized antenna," CA809812 (A), 1 Apr. 1969; S. Lindenmeier, H. Lindenmeier, "Antenna for satellite reception," US2009073072 (A1), 19 Mar. 2009; Y. Tsutsumi, M. Nishio, "Circularly polarized antenna device," US2008309562 (A1), 18 Dec. 2008; E. Oka, "Circularly-polarized wave composite monopole antenna," JP2009225068 (A), 1 Oct. 2009; Y. Tsutsumi, "Circularly polarized antenna, semiconductor module, and wireless device," JP2009105503 (A), 14 May. 2009; K. Ogino, K. Takayama, "Circular polarization antenna," JP4278534 (B2), 17 Jun. 2009; V. Marco, "Allround aerial arrangement for receiving terrestrial and satellite signals," MXPA03010485 (A), 6 Dec. 2004; K. Ogino, K. Takayama, "Thin antenna," JP4383814 (B2), 16 Dec. 2009; "Antenna for motor vehicle terrestrial and satellite radio reception, has crossed dipole antenna arranged at one end of baseplate, and monopole at other end," DE20314442 (U1), 20 Nov. 2003; P. D. Mckivergan, C. E. Rossman, "Low profile Tri-filar, single feed, circularly polarized helical antenna," U.S. Pat. No. 6,816,127 (B2), 9 Nov. 2004; C. G. Jan, S. J. Guo, "Combined antenna," TW580779 (B), 21 Mar. 2004; M. Ikeda Masakazu, H. Nakano, "Antenna for receiving circularly polarized wave," JP3848603 (B2), 22 Nov. 2006; A. Shigihara, "Compound antenna," JP2003110355 (A), 11 Apr. 2003; P. W. Hannan, A. R. Lopez, "Eight-element anti-jam aircraft GPS antennas," U.S. Pat. No. 6,618,016 (B1), 9 Sep. 2003; K. Tsukamoto, "Composite planar antenna," JP8237025 (A), 13 Sep. 1996; K. Arimura, H. Kasuga, "Surface wave slot array antenna," JP5183329 (A), 23 Jul. 1993; A. Kuramoto "Circularly polarized wave antenna," JP2526673 (B2), 21 Aug. 1996; M. G. Munson, R. E. Munson, "Monopole/L-shaped parasitic elements for circularly/elliptically polarized wave transceiving," CA1322046 (C), 7 Sep. 1993; S. Yamawaki, "Non-directional antenna shaped for polarized wave," JP2224408 (A), 6 Sep. 1990; H. J. Ellis, "Coaxial phased array antenna," CA1145843 (A1), 3 May. 1983; M. Ono, T. Numazaki, "Cross slot antenna," JP1282138 (C), 27 Sep. 1985; J. Epis, "Broadband cup-dipole and cup-turnstile antennas," U.S. Pat. No. 3,740,754 (A), 19 Jun. 1973; R. C. Dempsey, "Foldable antenna operable in dual modes," U.S. Pat. No. 3,665,478 (A), 23 May. 1972; M. Takahashi, "Antenna," JP9232835 (A), 5 Sep. 1997; T. E. Roberts, Y. Hwang, "Near isotropic circularly polarized antenna," U.S. Pat. No. 4,958,162 (A), 18 Sep. 1990; L. Y. Feng, C. G. Sun, "Array antenna of circularly polarized dielectric resonator," CN101719599 (A), 2 Jun. 2010; "Circularly polarized dielectric resonator antenna," KR100588765 (B1), 14 Jun. 2006; T. H. Chang, J. F. Kiang, "Circularly-polarized dielectric resonator antenna," U.S. Pat. No. 7,782,266 (B2), 24 Aug. 2010; T. H. Chang, J. F. Kiang, "Circularly-polarized dielectric resonator antenna" U.S. Pat. No. 7,541,998 (B1), 2 Jun. 2009; P. Lafleur, "Miniature circularly polarized patch antenna," WO2005065289 (A3), 15 Jun. 2006; P. Lafleur, "Miniature circularly polarized patch antenna," U.S. Pat. No. 7,064,714 (B2), 20 Jun. 2006; R. Gillard, A. Laisne, "Circularly polarized dielectric resonator antenna," WO03019718 (A1), 6 Mar. 2003; M. A. Tassoudji, E. T. Ozaki, "Circularly polarized dielectric resonator antenna," HK1041369 (A1), 29 Dec. 2006; J. S. Guo, J. Y. Huang, "Frequency adjustable circularly polarized dielectric resonator antenna," TW518800 (B), 21 Jan. 2003; H. Uchimura, "Aperture antenna and board with the aperture antenna," JP2002353727 (A), 6 Dec. 2002; M. A. Tassoudj, E. T. Ozaki, "Circularly polarized dielectric resonator antenna," EP1826868 (A3), 3 Oct. 2007; T. Takenoshita, "Layered type aperture antenna," JP2001068924 (A), 16 Mar. 2001; M. B. Oliver, Y. M. M. Antar, "Broadband circularly polarized dielectric resonator antenna," U.S. Pat. No. 5,940,036 (A), 17 Aug. 1999; M. B. Oliver, Y. M. M. Antar, "Broadband circularly polarized dielectric resonator antenna," CA2176656 (C), 28 Oct. 2003; T. Fukagawa, T. Adachi, "Dielectric resonator antenna," JP9008539 (A), 10 Jan. 1997; S. J. Fiedziuszko, "Dielectric resonator filter with coupling ring and antenna system formed therefrom," U.S. Pat. No. 5,517,203 (A), 14 May. 1996; S. Haruyama, Y. Kagoshima, "Antenna system," JP7112131 (B), 29 Nov. 1995; S. Haruyama, Y. Kagoshima, "Antenna system for right and left rotatory two-circularly polarized waves," JP2108648 (C), 21 Nov. 1996; M. N. Wong, R. J. Patin, "Focal plane array antenna," U.S.

Pat. No. 4,980,693 (A), 25 Dec. 1990; H. Nakai, "Microstrip antenna," JP1051805 (A), 28 Feb. 1989; "Stripline antenna arrays," GB1529361 (A), 18 Oct. 1978; K. Ogino, Y. Umezawa, "Non-directional antenna," JP2006270602 (A), 5 Oct. 2006; T. Teshirogi, K. Iigusa, "Slot array antenna," JP2824505 (B2), 11 Nov. 1998; S. Uchino, "Microstrip antenna," JP4150503 (A), 25 May. 1992; S. Yamawaki, "Non-directional antenna shaped for polarized wave," JP2224408 (A), 6 Sep. 1990; N. Hasebe, "Omni-directional antenna," JP2599430 (B2), 9 Apr. 1997; Y. Suzuki Yasuo, "Direction finding microstrip antenna," JP2023748 (C), 26 Feb. 1996; S. Yamawaki, "Non-directional antenna," JP63048003 (A), 29 Feb. 1988; Y. Yokoyama, "Land mobile communication system," JP1801735 (C), 12 Nov. 1993; H. Longaker, "Differential navigation system for remote mobile users," U.S. Pat. No. 4,751,512 (A), 14 Jun. 1988; "Improvements in antennas of the solid dielectric type," GB660034 (A), 31 Oct. 1951; M. G. Guler, E. L. Cross, "Antenna Polarization Control," US2010109960 (A1), 6 May. 2010; D. V. Gupta, K. Wood, "System and apparatus for high data rate wireless communications," US2008002652 (A1), 3 Jan. 2008; D. V. Gupta, K. Wood, "System and apparatus for high data rate wireless communications," WO2006053215 (A9), 6 Jul. 2006; A. I. Zagiiloul, E. C. Kohls, "Dual circular polarization flat plate antenna that uses multilayer structure with meander line polarizer," US2005062661 (A1), 24 Mar. 2005; A. I. Zaghloul, E. C. Kohls, "Dual circular polarization flat plate antenna that uses multilayer structure with meander line polarizer," WO02084801 (A1), 24 Oct. 2002; H. U. Jung, J. W. Lee, "Base station transmitter and subscriber receiver using circular polarization and method for designing and extending cells using the same," KR20010037645 (A), 15 May. 2001; M. Havkin, E. Orleansky, "Polarizer reflector and reflecting plate scanning antenna including same," U.S. Pat. No. 4,599,623 (A), 8 Jul. 1986; and "Waveguide assembly including a member of ferromagnetic material," GB804518 (A), 19 Nov. 1958.

SUMMARY OF THE INVENTION

An object of the invention is to mitigate or obviate to some degree one or more problems associated with known elliptically or circularly polarized dielectric resonant or block antennas.

The above object is met by the combination of features of the main claim; the sub-claims disclose further advantageous embodiments of the invention.

Another object of the invention is to provide an elliptically or circularly polarized dielectric resonant or block antenna of simple structure.

A further object of the invention is to provide an elliptically or circularly polarized dielectric resonant or block antenna having a wave polarizer directly integrated with the structure of a linearly polarized dielectric resonant or block antenna.

One skilled in the art will derive from the following description other objects of the invention. Therefore, the foregoing statements of object are not exhaustive and serve merely to illustrate some of the many objects of the present invention.

In one or more embodiments, the invention provides an elliptically polarized (EP) dielectric block antenna comprising a linearly polarized (LP) dielectric block antenna and a wave polarizer integrated with the LP dielectric block antenna. The wave polarizer converts the LP wave of the LP dielectric block antenna into an EP wave or a circularly polarized (CP) wave. The wave polarizer is directly integrated with a component of the LP dielectric block antenna by fabricating inclined slots on faces of the dielectric block at an oblique angle to the LP wave direction of polarization. This provides a very compact EP or CP antenna with a broadside or omni-directional radiation pattern. The EP or CP antenna may be excited by an inner conductor of a SubMiniature version A (SMA) connector that can be directly connected to a coaxial line thereby providing a simple feed network for the antenna.

In a first main aspect of the invention, there is provided an elliptically polarized (EP) or circularly polarized (CP) dielectric block antenna comprising: a linearly polarized (LP) dielectric block antenna; and a wave polarizer integrated with the LP dielectric block antenna, wherein the wave polarizer converts the LP wave of the LP dielectric block antenna into an EP or CP wave.

In other embodiments, integrating the wave polarizer with the LP antenna structure simplifies the resulting EP or CP dielectric block antenna.

The wave polarizer is preferably integrated with the dielectric block of the LP dielectric block antenna. Preferably, the wave polarizer comprises one or more slots formed in the dielectric block of the LP dielectric block antenna, each of said one or more slots being arranged at an oblique angle to the direction of polarization of said LP dielectric block antenna. This provides a convenient and structurally simple method of directly implementing a wave polarizer in an LP dielectric block antenna to convert said LP antenna to an EP or CP antenna without any resulting increase in size.

More particularly, the wave polarizer may comprise two or more slots formed in the dielectric block of the LP dielectric block antenna. Said two or more slots formed in the dielectric block of the LP dielectric block antenna may be arranged at the same oblique angle or at different oblique angles to the direction of polarization of said LP dielectric block antenna.

Preferably, the wave polarizer comprises a plurality of slots formed in the dielectric block of the LP dielectric block antenna, each slot preferably formed in a respective face of said dielectric block. The plurality of slots may be formed in respective side faces of the dielectric block at an oblique angle to an axis passing through a remaining two unslotted faces of the dielectric block, said axis being parallel with the direction of polarization of the LP dielectric block antenna. It can be seen that, in preferred embodiments, a slot is provided in each face of the dielectric block that lies parallel with the direction of polarization of the LP antenna whereas those faces that lie perpendicular to said direction of linear polarization remain unslotted. Each of the plurality of slots may extend fully across its respective face of the dielectric block or they may each extend only partially across their respective face of the dielectric block. In some embodiments, one or more of the slots may extend fully across its respective face whereas at least one other slot extends only partially across its respective face.

In a preferred embodiment, the dielectric block comprises a cuboid block of dielectric material, although any shape of dielectric block can be utilized in the antenna of the invention. In the case of a cuboid dielectric element or block, there are preferably four slots forming the wave polarizer, said four slots formed in respective side faces of the cuboid block at an oblique angle to an axis passing through a remaining two unslotted faces of the cuboid block, said axis being parallel with the direction of polarization of the LP dielectric block antenna.

Preferably, the EP or CP dielectric block antenna further comprises a connector which mounts a probe for feeding the dielectric block, said probe extending into said block and being received generally centrally of the dielectric block. The probe may comprise a coaxial feed probe. A flange of said connector may comprise a ground plane of the antenna, said flange having an area substantially less than an area of a face of the dielectric block adjacent to which said flange is positioned. This negates the need for a separate ground plane for the resulting EP or CP antenna.

The probe extends into a cavity inside said dielectric block. In one embodiment, the cavity comprises a hole drilled or otherwise formed in the dielectric block whereby the hole has a diameter closely matching that of the probe. In other embodiments, the cavity may be substantially larger than the probe whereby a substantial air gap exists between the probe and an inner surface of the dielectric block defining the cavity.

In some embodiments, there may be provided a parasitic patch located adjacent a face of the dielectric block opposing the face adjacent which is located the ground plane.

In some embodiments, there may be provided a parasitic strip located in at least one of said one or more slots.

In one most preferred embodiment, the dielectric block antenna comprises a CP dielectric block antenna.

In another most preferred embodiment, the EP or CP dielectric block antenna has a broadside or an omnidirectional radiation pattern.

In a second main aspect of the invention, there is provided a method of forming an EP or CP dielectric block antenna comprising the step of: integrally forming a wave polarizer with a LP dielectric block antenna, wherein the wave polarizer converts the LP wave of the LP dielectric block antenna into an EP or CP wave.

In a third main aspect of the invention, there is provided an electronic apparatus having an EP or CP dielectric block antenna, said dielectric block antenna comprising: a LP dielectric block antenna; and a wave polarizer integrated with the LP dielectric block antenna, wherein the wave polarizer converts the LP wave of the LP dielectric block antenna into an EP or CP wave. The electronic apparatus may comprise a fixed or mobile wireless station or apparatus, a base station, a ground, ship or airplane antenna by way of example, but without limitation.

In a fourth main aspect of the invention, there is provided a dielectric block for an EP or CP dielectric block antenna, comprising: a dielectric block having a cavity for receiving a feed probe; and one or more slots formed in respective faces of said dielectric block at an oblique angle to a longitudinal axis of said cavity.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figures, of which:

FIG. 1(*b*) is a front view of the dielectric block antenna according to the first embodiment of the invention;

FIG. 2(*b*) is a photographic representation showing the bottom face of the prototype of the antenna of FIG. 1 and showing a feed probe separated from the dielectric block of the antenna;

FIG. 7(*b*) is a front view of the dielectric block antenna according to the second embodiment of the invention;

FIG. 11(*b*) is a front view of the dielectric block antenna according to the third embodiment of the invention;

DETAILED DESCRIPTION OF ILLUSTRATIVE EMBODIMENTS

Figure 1A:
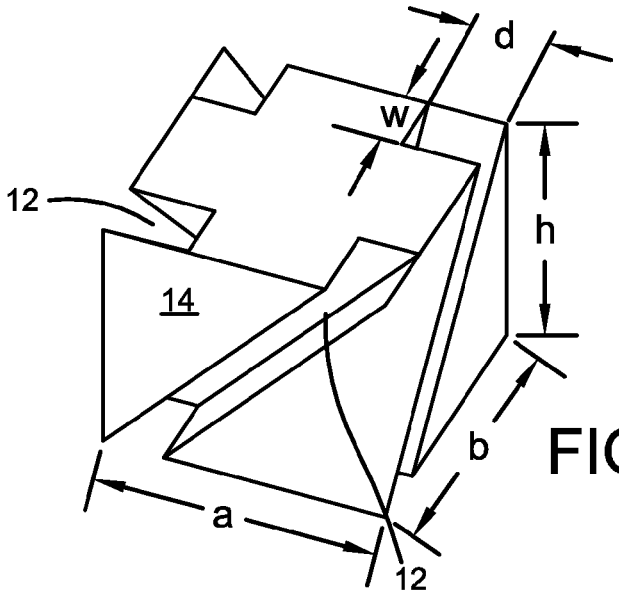
FIG. 1(*a*) is a perspective view of a dielectric block for an antenna according to a first embodiment of the invention.

The following description is of a preferred embodiment by way of example only and without limitation to the combination of features necessary for carrying the invention into effect.

Referring to FIGS. 1 to 6, there is shown a first embodiment of an antenna according to the invention.

The EP or CP dielectric block antenna 10 comprises a linearly polarized (LP) dielectric block antenna and a wave polarizer directly integrated with said LP dielectric block antenna. The wave polarizer converts the LP wave of the LP dielectric block antenna into an EP or CP wave. The wave polarizer is directly integrated with a component of the LP dielectric block antenna by fabricating inclined slots 12 on faces of the dielectric block 14 at an oblique angle θ to the LP wave direction of polarization (direction z in FIG. 1(*b*)). This provides a very compact EP or CP antenna 10 with an omnidirectional radiation pattern. The EP or CP antenna 10 is excited by an inner conductor of a SubMiniature version A (SMA) connector 16 that can be directly connected to a coaxial line thereby providing a simple feed network for the antenna. Integrating the wave polarizer with the LP antenna structure simplifies the resulting EP or CP dielectric block antenna 10.

The dielectric block 14 comprises a cuboid block of dielectric material, although it will be understood that any shape of dielectric block can be utilized in the antenna of the invention. Four slots 12 form the wave polarizer, said four slots 12 being formed in respective side faces of the cuboid block at an oblique angle to an axis passing through a remaining two unslotted faces of the cuboid block, said axis being parallel with the direction of polarization of the LP dielectric block antenna. The SMA connector 16 mounts a coaxial probe 18 for feeding the dielectric block, said probe 18 extending into said block 14 and being received generally centrally of the dielectric block 14. A flange 20 of said connector comprises a ground plane of the antenna 10, said flange 20 having an area substantially less than an area of the bottom face of the dielectric block adjacent to which said flange is positioned. This negates the need for a separate ground plane for the resulting EP or CP antenna 10.

The probe 18 extends into a cavity inside said dielectric block 14. In this embodiment, the cavity comprises a hole drilled or otherwise formed in the dielectric block 14 whereby the hole has a diameter closely matching that of the probe 18.

It will be understood that circular polarization is merely a special instance of elliptical polarization whereby the magnitudes of the two orthogonal field components that can be used to define the CP wave have the same magnitude whereas, in the case of an EP wave, the magnitudes of the two orthogonal field components differ over time.

Figure 1B:
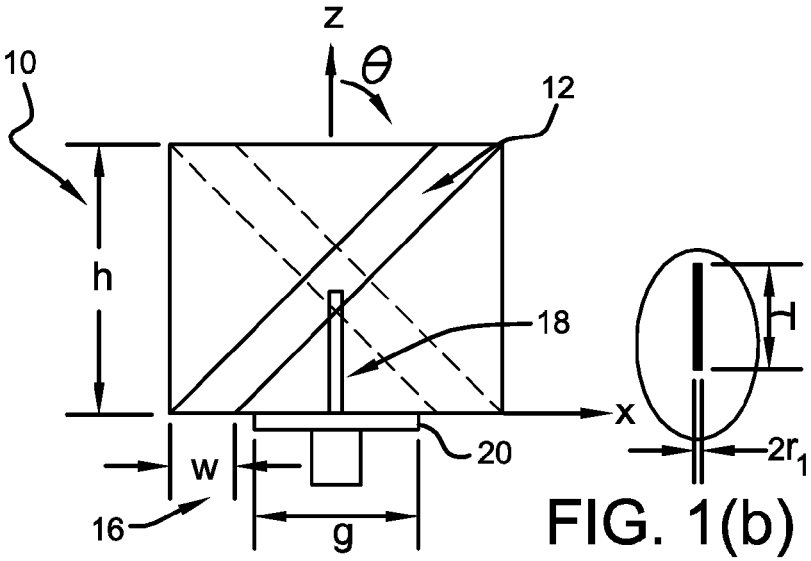

Considering the first embodiment in more detail, FIG. 1 more particularly shows the configuration of an omnidirectional CP antenna 10 in accordance with said first embodiment of the invention. The CP omnidirectional dielectric block antenna 10 comprises a slotted rectangular dielectric block 14 of length a, width b, and height h, which has oblique slots 12 fabricated on its four sidewalls. Each slot 12 has a width of wand a depth of d. The dielectric block 14 is centrally fed by a coaxial probe 18 of length l and radius $r_1$ (as better seen in the enlarged portion of FIG. 1(*b*)). The probe 18 extends from an inner conductor of a SMA connector 16, which has a square flange 20 acting as a (small) ground plane of the antenna. The flange 20 could comprise other shapes other than a square. The centrally probe-fed rectangular dielectric block 14 is excited in its dominant TM mode, which radiates like a short electric monopole and radiates omnidirectionally in the horizontal plane. Due to the perturbation of the slots 12, the omnidirectional LP field excited by the probe 18 can be decomposed into two orthogonal field components with different velocities. By tuning the slot size, the two orthogonal field components can be made equal in magnitude but different in phase by 90°. As a result, an omnidirectional CP wave is generated.

In this embodiment, since the field is predominantly vertically polarized, oblique slots 12 are needed to obtain the polarizer effect that converts the LP field into the CP field. The CP antenna with the slots oriented as shown in FIG. 1 will generate left-hand CP (LHCP) fields, but right-hand CP (RHCP) fields can be obtained by aligning the slots with the other diagonals of the sidewalls.

In this embodiment, the flange 20 of the SMA connector 16 is used as a small ground plane and no additional ground plane is added or required for the antenna 10, so that the radiation can be enabled in the end-fire direction (θ=90°). The CP performance may be destroyed if a large ground plane is used.

Figure 2A:
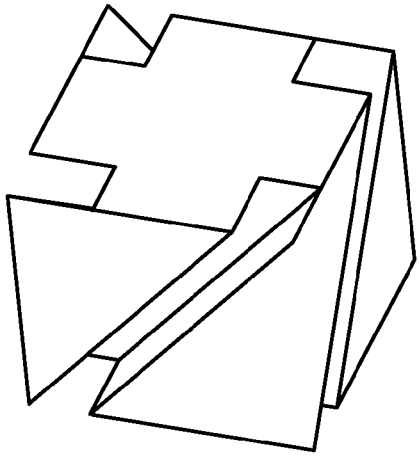
FIG. 2(*a*) is a photographic representation showing the top face and sidewalls of a prototype of the antenna of FIG. 1.
Figure 2B:
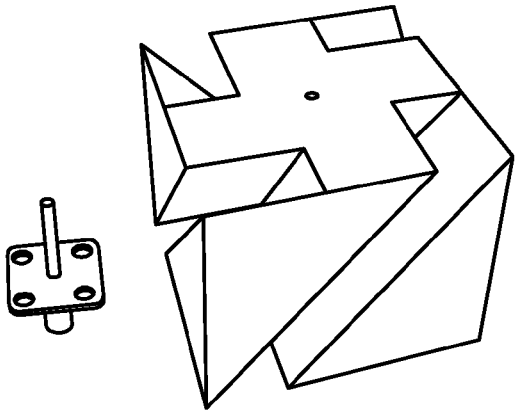

To experimentally demonstrate the antenna design according to the first embodiment of the invention, an omnidirectional LHCP antenna was fabricated for 2.4-GHz WLAN applications. FIG. 2 shows two photographic representations of the resulting prototype. The detailed dimensions are given by $\in_r$=15, a=b=39.4 mm, h=33.4 mm, w=9.4 mm, d=14.4 mm, $r_1$=0.63 mm, l=12.4 mm, and g=12.7 mm (using the reference notation of FIG. 1). FIG. 2(*a*) shows the top face and sidewalls of the dielectric block, whereas FIG. 2(*b*) shows the bottom face of the antenna with the feed probe shown separated from the dielectric block. The feed probe (signal launcher) is inserted into the hole drilled or otherwise formed at the center of the bottom face.

Figure 3:
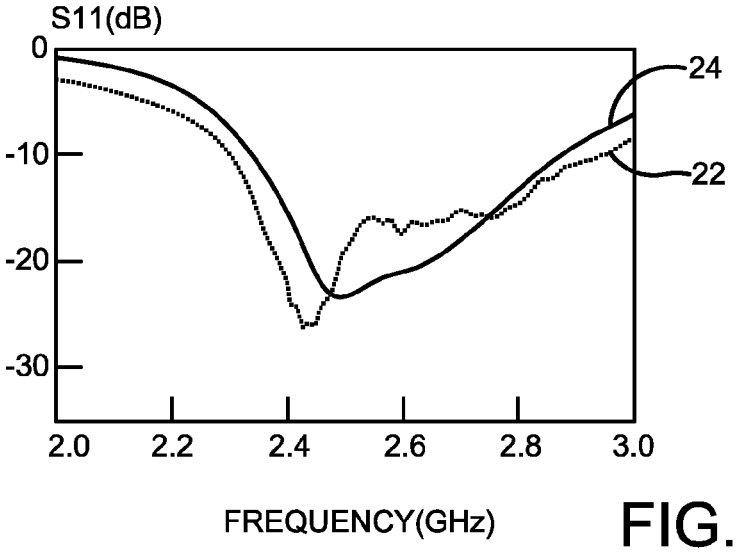
FIG. 3 shows measured and simulated reflection coefficients of the prototype antenna of FIG. 2.
Figure 4:
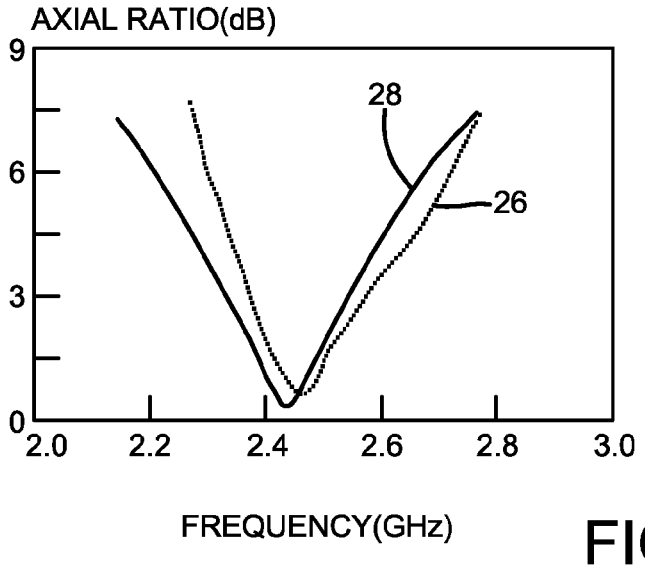
FIG. 4 shows measured and simulated axial ratios (ARs) of the prototype antenna of FIG. 2 in the +x direction.

Measured results for the prototype antenna of FIG. 2 were compared with HFSS™ simulations. HFSS™ is an industry-standard simulation tool for 3D full-wave electromagnetic field simulation. FIG. 3 shows the measured 22 and simulated 24 reflection coefficients of the CP antenna 10 of FIGS. 1 and 2. Reasonable agreement between said measured 22 and simulated 24 results can be observed. The discrepancy between them is caused by experimental tolerances and imperfections including the inevitable airgap between the probe 18 and the hole in the dielectric block 14. The measured and simulated 10-dB impedance bandwidths are 24.4% (2.30-2.94 GHz) and 20.3% (2.34-2.87 GHz), respectively. FIG. 4 shows the measured 26 and simulated 28 axial ratios (ARs) of the CP antenna 10 in the +x direction (θ=90°, ϕ=0°). Almost the same results were obtained for other values of ϕ with θ=90°, showing that it is a good omnidirectional antenna. From the figure, it can be found that the measured 3-dB AR bandwidth is given by 7.3% (2.39-2.57 GHz), which agrees reasonably well with the simulated value of 8.2% (2.34-2.54 GHz). The bandwidth is more than enough for the 2.4-GHz WLAN band. It is noted that the entire measured AR passband falls within the impedance passband and, thus, the entire AR passband is usable. This result is very desirable.

Figure 5:
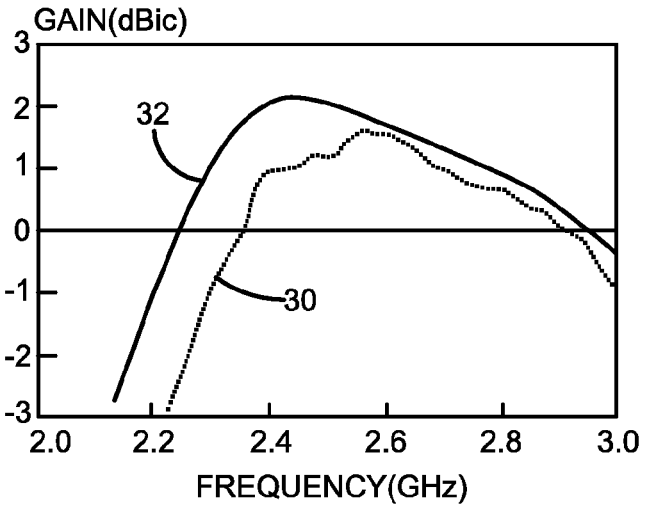
FIG. 5 shows measured and simulated antenna gains of the prototype antenna of FIG. 2.

FIG. 5 shows the measured 30 and simulated 32 antenna gains. With reference to the figure, good agreement between the measured 30 and simulated 32 results can be observed. The measured antenna gain varies between 0.91 dBic and 1.60 dBic across the AR passband (2.39-2.57 GHz).

Figure 6:
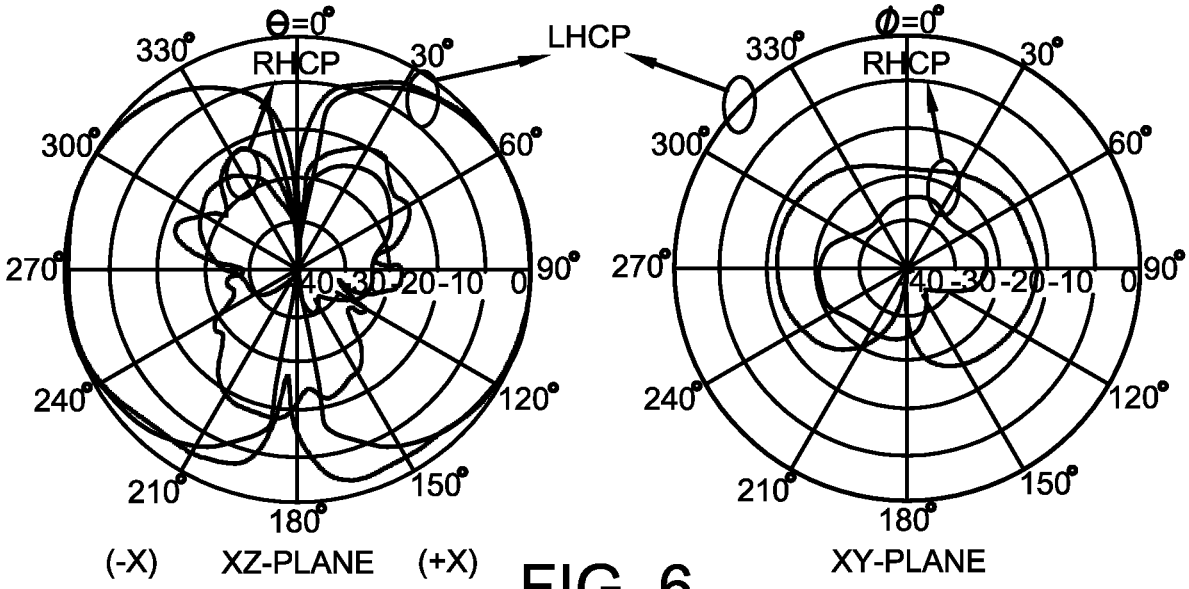
FIG. 6 shows measured and simulated radiation patterns of the prototype antenna of FIG. 2 in the xz and xy-planes.

FIG. 6 shows the radiation patterns of the xz and xy planes and very good omnidirectional performance can be observed. It can be seen that the LHCP fields are stronger than the crosspolarized (RHCP) fields by about 20 dB, only except for a small region around the z axis. The yz-plane field pattern was also simulated and measured. It was found that the results are similar to that of the xz plane, which is expected because of the symmetry of the structure.

It can be understood from the foregoing that a primary aspect of the invention is the formation of a CP dielectric block antenna by directly fabricating or forming slots in the dielectric block to construct an integrated wave polarizer for converting an LP wave into an EP or CP wave. The concept of integrating a wave polarizer with an LP antenna as hereinbefore described applies to all kinds of EP and CP dielectric antennas, including but not limited to those providing an omnidirectional or broadside radiation patterns.

It should be noted that the dielectric constant ($\in_r$) of the dielectric block can be of any value and that the dielectric block can be operated at or off resonance. As already mentioned, the dielectric block can be of any shape, although a cuboid shape offers a good building block for an antenna.

Wave perturbation can be effected by a slot or aperture of any geometry and inclination angle. Therefore, it should be understood that, whilst the foregoing description refers to slots, this is to be taken to include apertures formed through the dielectric block at inclined angles to the LP direction of polarization.

The direction of inclination of the slots on the dielectric block determines whether the CP antenna is LHCP or RHCP. The same applies to an EP antenna.

Furthermore, an antenna according to the first embodiment can be arranged in an array of such antennas to form an antenna array.

It will also be understood from the foregoing that the wave polarizer in the antenna according to the first embodiment preferably comprises two or more slots formed in the dielectric block of the LP dielectric block antenna and that said two or more slots may be arranged at the same oblique angle or at different oblique angles to the direction of polarization of said LP dielectric block antenna. Each of the slots may extend fully across its respective face of the dielectric block or they may each extend only partially across their respective face of the dielectric block. In some embodiments, one or more of the slots may extend fully across its respective face whereas at least one other slot extends only partially across its respective face.

Referring to FIGS. 7 to 10, there is shown a second embodiment of an antenna according to the invention. Like numerals will be used to denote generally like parts to those of the first embodiment.

Figure 7A:
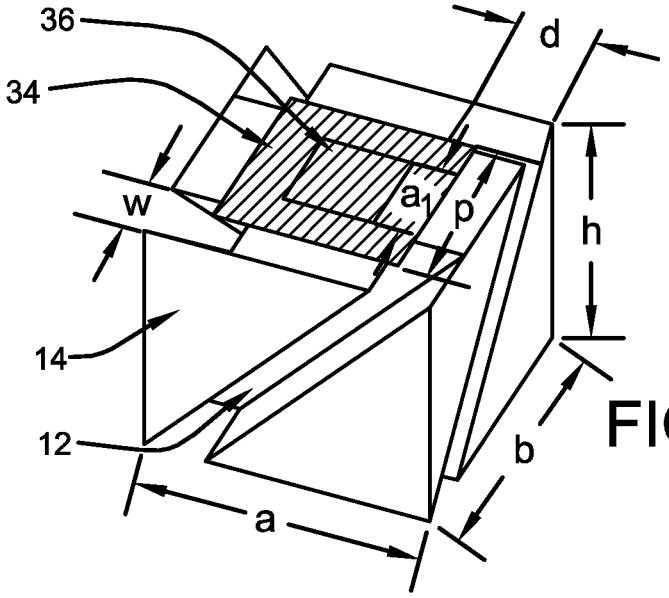
FIG. 7(*a*) is a perspective view of a dielectric block for an antenna according to a second embodiment of the invention.
Figure 7B:
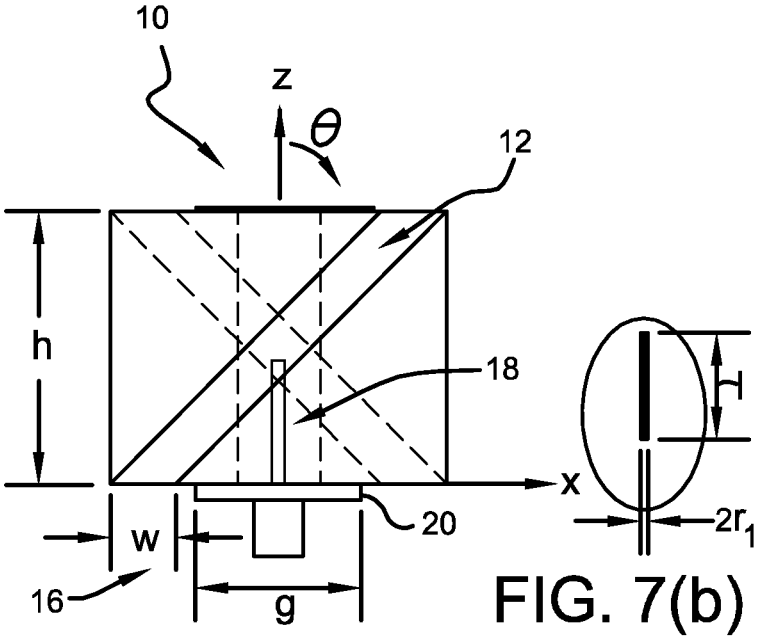

The configuration of the antenna 10 according to the second embodiment as shown in FIG. 7 is similar to that of the first embodiment. This embodiment also has a slotted rectangular dielectric block 14, but differs from the first embodiment in that it has a square metallic parasitic patch 34 laid on its top side, although the parasitic patch 34 may comprise other shapes. In contrast to the first embodiment, the slotted rectangular dielectric block 14 is hollow having a central cavity 36 instead of a drilled hole or the like to accommodate the probe 18.

Simulated results for this embodiment of the antenna 10 according to the invention shows that the AR bandwidth can be increased significantly by adding the parasitic patch 34, whereas the wide impedance bandwidth can be maintained by introducing a hollow cylindrical cavity 36 at the center of the dielectric element 14. It should be noted that the hollow cylindrical cavity 36 can be of any cross section.

To validate the design of the second embodiment of the antenna 10 according to the invention, a wideband omnidirectional LHCP antenna 10 for Worldwide Interoperability for Microwave Access (WIMAX) applications (3.4-3.7 GHz) system was fabricated. The hollow rectangular dielectric block 14 has a dielectric constant of $\in_r$=15, with dimensions of a=b=37 mm, h=26 mm, $a_1$=10 mm, w=10 mm and d=14.5 mm. The square metallic parasitic patch 34 lying at the top of the dielectric has a side length of p=32.5 mm. The dielectric block 14 is once again centrally fed by a probe 18 of radius $r_1$=0.63 mm and length l=19.6 mm (as better seen in the enlarged portion of FIG. 7(*b*)). Again, the SMA flange 20 with a side length of g=12.7 mm is used as the small ground plane and no additional ground plane is added or required.

Figure 8:
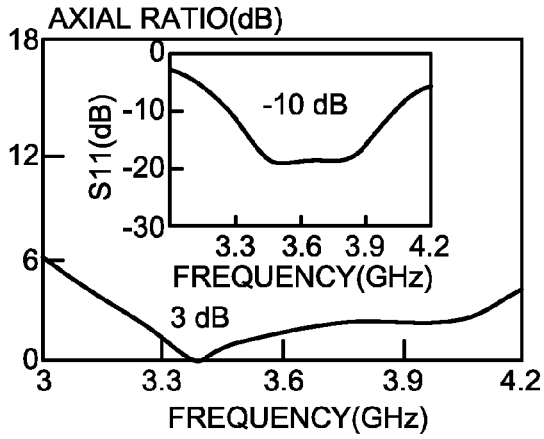
FIG. 8 shows a simulated AR of the wideband antenna of FIG. 7 in the +x direction with the inset showing the corresponding reflection coefficient.

For this embodiment, FIG. 8 shows the simulated AR of the wideband omnidirectional CP antenna, whereas the inset shows the corresponding reflection coefficient. As can be observed from the figure and inset, the simulated 3-dB AR bandwidth is 24.6% (3.2-4.1 GHz), and the 10-dB impedance bandwidth is given by 20.8% (3.27-4.03 GHz). It has been found that the impedance bandwidth is almost the same as for the first embodiment of FIGS. 1 to 6, but the AR bandwidth is as wide as ~3 times of that obtained for the first embodiment. The usable overlapping bandwidth is 20.8%, which is more than sufficient for a WIMAX system.

Figure 9A:
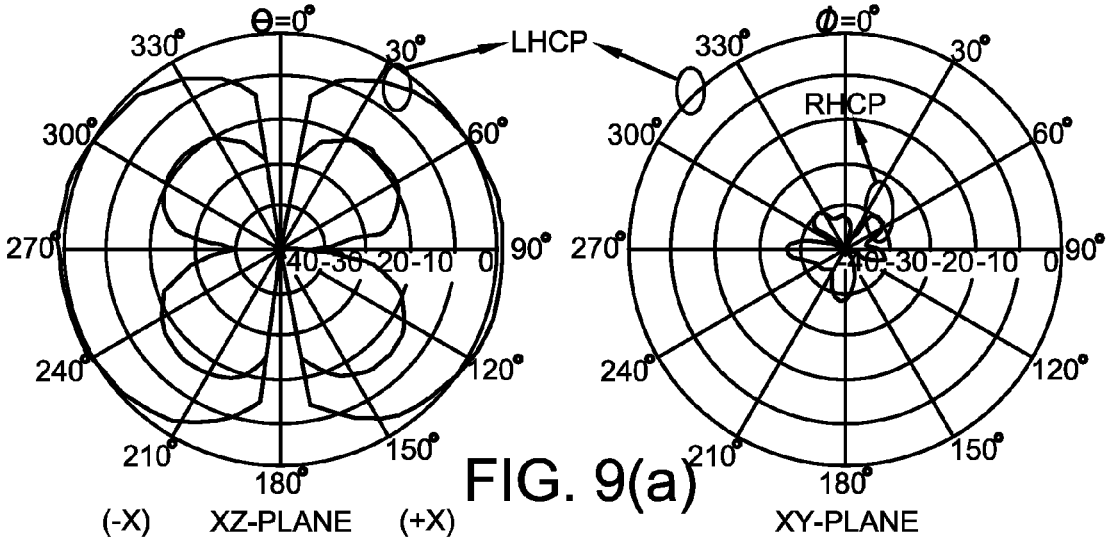
FIG. 9 shows simulated radiation patterns of the antenna of FIG. 7 at (a) 3.4 GHz and (b) 3.9 GHz.
Figure 9B:
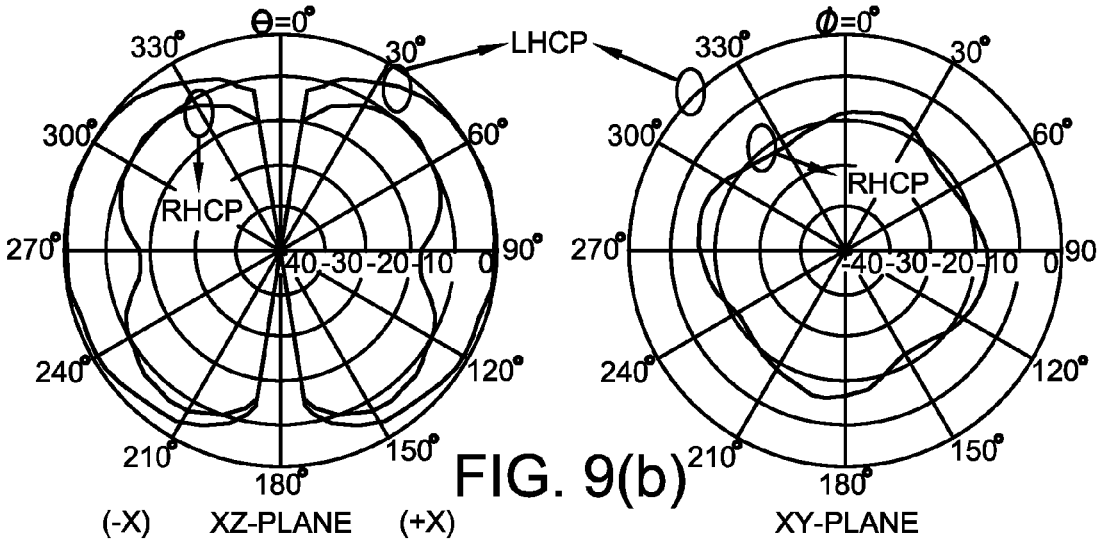
Figure 10:
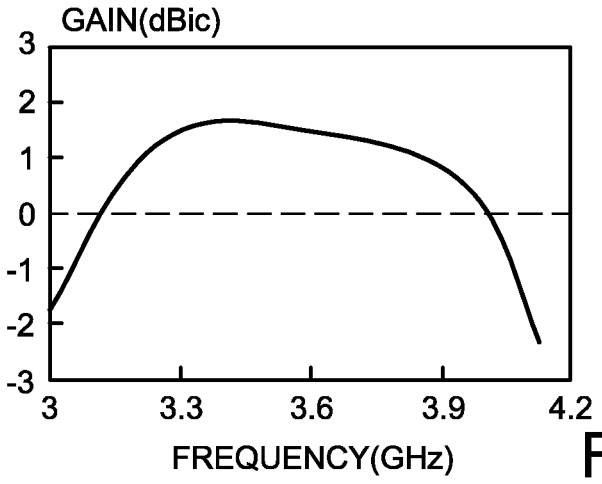
FIG. 10 shows simulated gain of the antenna of FIG. 7.

Also for this embodiment, FIG. 9 shows the simulated radiation patterns of the CP antenna. As can be expected, similar results were obtained for the yz plane. The simulated antenna gain of the wideband CP antenna is shown in FIG. 10. It is noted from the figure that the gain varies between −0.41 dBic and 1.66 dBic across the passband (3.27-4.03 GHz). The gain is 0 dBic at ~4 GHz.

Referring to FIGS. 11 to 14, there is shown a third embodiment of an antenna according to the invention. Like numerals will be used to denote generally like parts to those of the first and/or second embodiments.

Figure 11A:
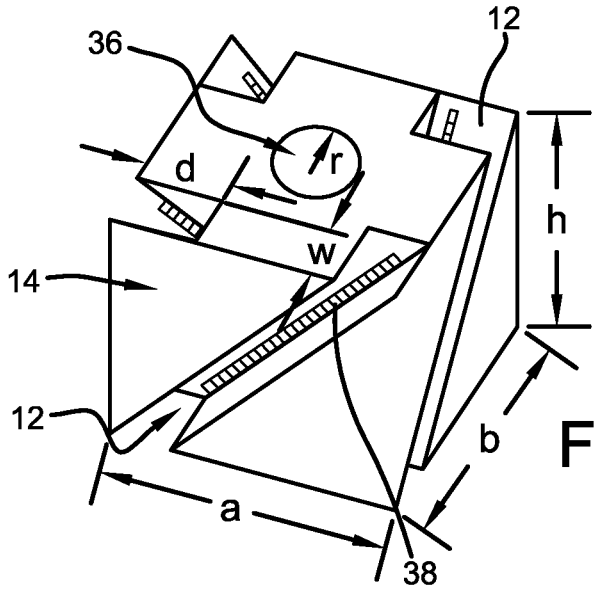
FIG. 11(*a*) is a perspective view of a dielectric block for an antenna according to a third embodiment of the invention.
Figure 11B:
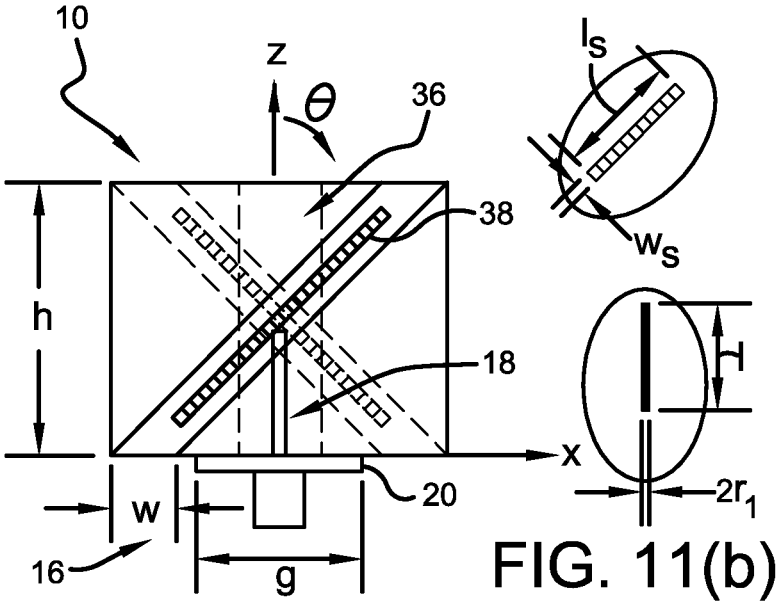

The configuration of the antenna 10 according to the third embodiment as shown in FIG. 11 is similar to that of the first (FIGS. 1 and 2) and second (FIG. 7) embodiments. This embodiment also has a slotted rectangular dielectric block 14 with a cavity 36, but differs from the first embodiment in that it has a parasitic strip 38 located in at least one of its slots 12.

More particularly as shown in FIG. 11, this embodiment of the omnidirectional CP antenna 10 of the invention has four parasitic metallic strips 38 lying inside its four lateral slots 12 (foam spacers can be used to support the suspended strips). The parasitic strips 38 can enhance the AR bandwidth significantly while giving a stable radiation pattern across the passband.

To validate the design of this embodiment, a wideband omnidirectional LHCP antenna 10 for a WIMAX system was fabricated. The hollow rectangular dielectric block 14 has a dielectric constant of $\in_r$=15, and the dimensions are given by a=b=30 mm, h=25 mm, r=3 mm, w=7 mm and d=10.5 mm. Four metallic strips 38 of length $l_s$=30.5 mm and width $w_s$=1 mm are placed inside respective slots 12 at a distance of $x_0$=6.4 mm from the surfaces of the dielectric block 14. The dielectric block 14 is centrally fed by a probe 18 of radius $r_1$=0.63 mm and length l=19 mm.

Figure 12:
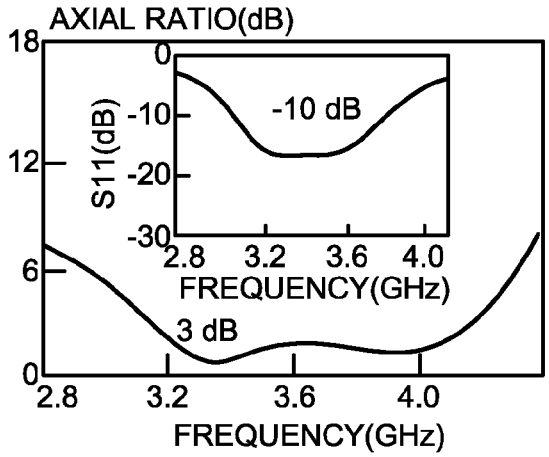
FIG. 12 shows a simulated AR of the antenna of FIG. 11 in the +x direction with the inset showing the corresponding reflection coefficient.

For this embodiment, FIG. 12 shows the simulated AR of the wideband omnidirectional CP antenna 10, whereas the inset in FIG. 12 shows the corresponding reflection coefficient. As can be observed from the figure and its inset, the simulated 3-dB AR bandwidth is 24.8% (3.11-3.99 GHz), and the 10-dB impedance bandwidth is given by 22.3% (3.11-3.89 GHz). The overlapping bandwidth is 22.3%, which is almost the same as for the second embodiment. The bandwidth is more than sufficient for a WIMAX system.

Figure 13A:
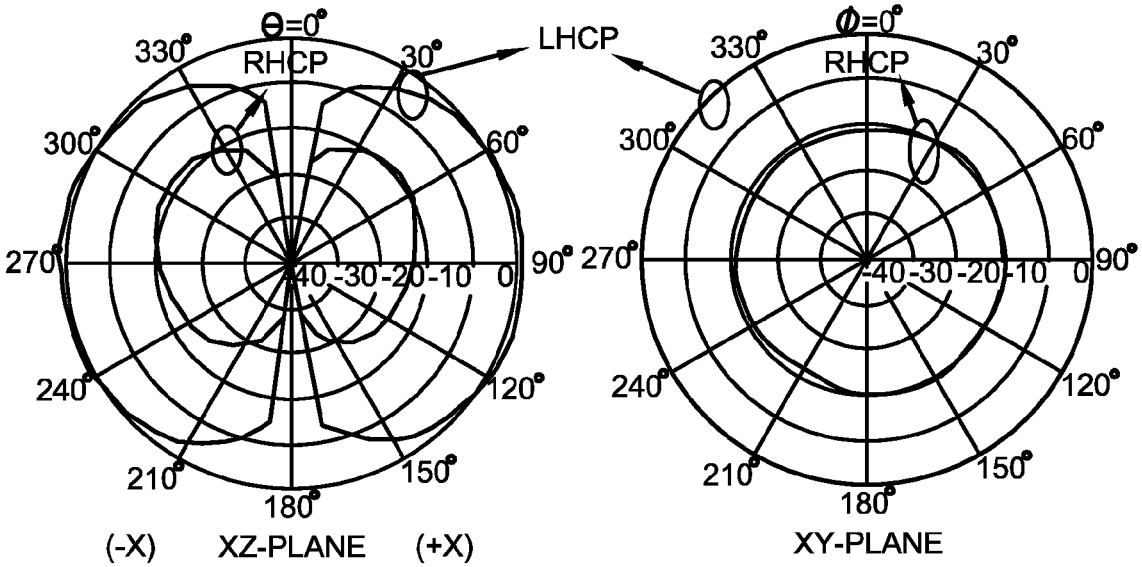
FIG. 13 shows simulated radiation patterns of the antenna of FIG. 11 at (a) 3.2 GHz and (b) 3.8 GHz.
Figure 13B:
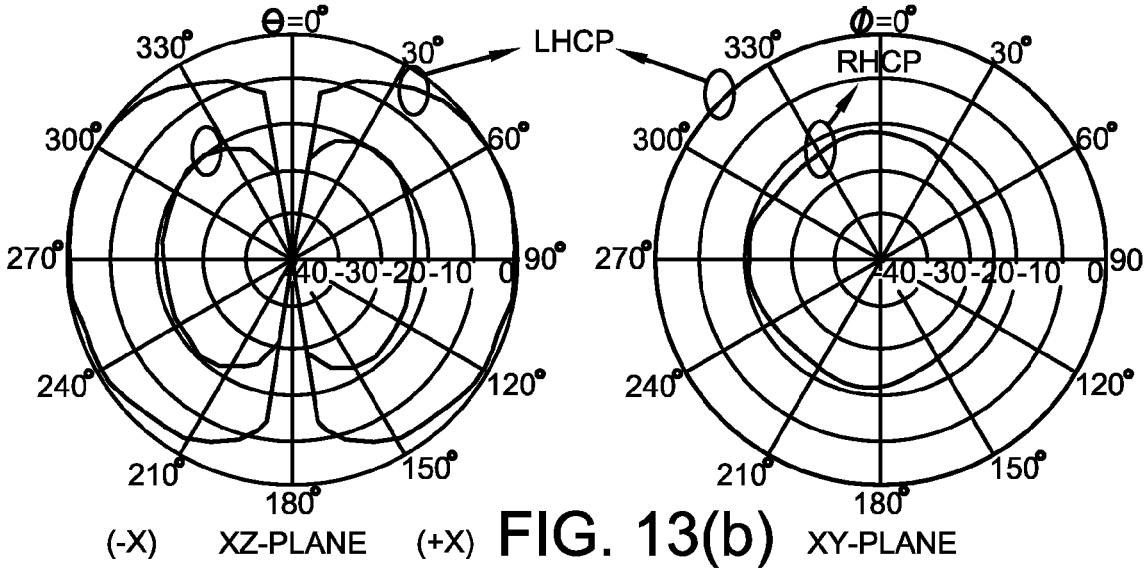
Figure 14:
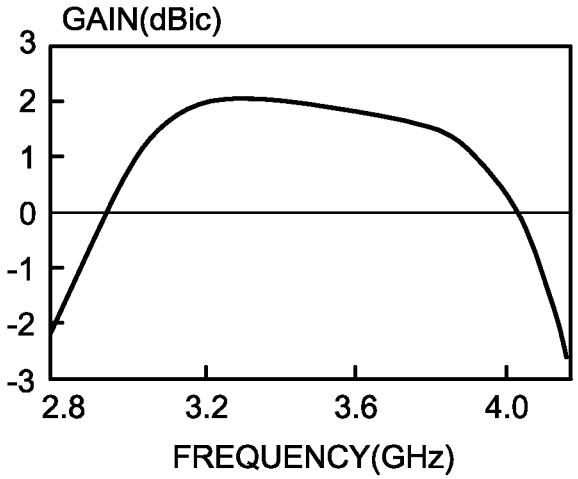
FIG. 14 shows simulated gain of the antenna of FIG. 11.

Also for this embodiment, FIG. 13 shows the simulated radiation patterns of the CP antenna at 3.2 GHz and 3.8 GHz, respectively. It was found that the results are similar to those of the first embodiment. The radiation pattern was also examined at other frequencies and found to be very stable across the entire passband. The simulated antenna gain of the CP antenna is shown in FIG. 14. The gain ranges from 1.24 dBic to 2.09 dBic in the passband (3.11-3.89 GHz), a bit higher than for the second embodiment.

As for the first embodiment, it can be seen from the second and third embodiments that an important concept of the invention is the direct fabrication or formation of slots 12 in a dielectric block 14 to construct an EP or CP dielectric wave polarizer. The idea of integrating the polarizer with the LP antenna applies to all kinds of EP and CP dielectric antennas, including but not limited to those providing an omnidirectional or broadside radiation patterns.

It can also be seen from the second and third embodiments that the concept of introducing parasitic metallic patches 34 and/or strips 38 enhances the AR bandwidth of the CP antenna 10. The patches and/or strips can be placed anywhere on the dielectric block.

The dielectric constant ($\in_r$) of the dielectric block can be of any value, including $\in_r$=1 for air or foam material—although $\in_r$=1 is applicable to the third embodiment of the antenna only.

The dielectric block, slot, metallic patch, and strip can be of any shape.

The CP antenna of the second and third embodiments can also be LHCP or RHCP and again the same applies to EP antennas.

The second and third embodiments can also be formed as arrays. In fact, an antenna array may be formed from any combination of antennas according to any of the first, second and third embodiments.

An omnidirectional EP or CP antenna according to any of the embodiments of the invention can not only suppress the multipath problem caused by signal reflections from building walls, the ground or the like, but also help to stabilize signal transmission and, thus, permit maximum freedom of choice of antenna location. Therefore, such antennas can cover a large service area, which is very attractive for wireless applications such as mobile networks and wireless local area network (WLAN) systems.

Figure 15:
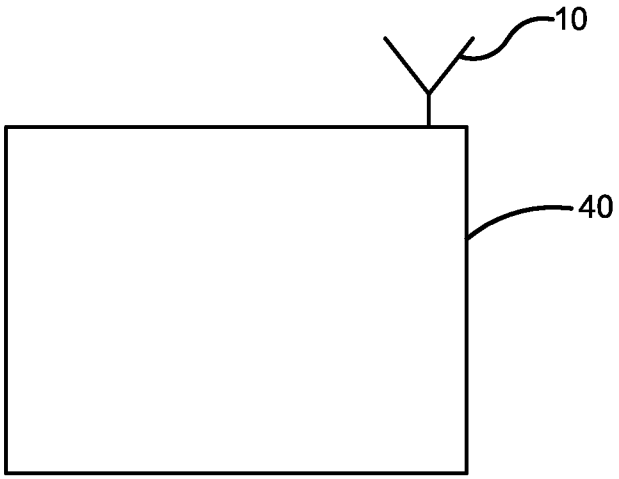
FIG. 15 is a block schematic diagram of an electronic apparatus including an antenna according to any of the embodiments of the invention.

FIG. 15 is a block schematic diagram of an electronic apparatus 40 including an antenna 10 according to any of the embodiments of the invention. The electronic apparatus 40 may comprise a fixed or mobile wireless station or apparatus, a base station, a ground, ship or airplane antenna by way of example, but without limitation.

An omnidirectional CP dielectric antenna according to the invention has the advantages of low loss, high radiation efficiency and relatively wide bandwidth. A wide range of dielectric constants can be used thereby allowing an antenna designer to obtain a reasonable antenna size and bandwidth.

In known antenna arrangements such as disclosed in U.S. Pat. No. 4,903,033 and U.S. Pat. No. 5,596,338 an external polarizer is placed around an LP antenna to achieve the CP wave radiation at the cost of substantially increasing the overall antenna size. In contrast, the antenna according to any embodiments of the invention directly integrates the polarizer with the dielectric block, giving a very compact omnidirectional CP antenna. In the present invention, the polarizer is directly integrated with the omnidirectional LP dielectric antenna by fabricating inclined slots on the dielectric. The proposed CP antenna is excited by the inner conductor of a SMA connector that can be directly connected to a 50Ω coaxial line, so the feed network is very simple.

In general, the invention provides an elliptically polarized (EP) dielectric block antenna comprising a linearly polarized (LP) dielectric block antenna and a wave polarizer directly integrated with a component of the LP dielectric block antenna. The wave polarizer converts the LP wave of the LP dielectric block antenna into an EP wave or a circularly polarized (CP) wave. The wave polarizer is directly integrated with the LP dielectric block antenna by fabricating inclined slots on faces of the dielectric block at an oblique angle to the LP wave direction of polarization. This provides a very compact EP or CP antenna with a broadside or omnidirectional radiation pattern. The EP or CP antenna is excited by an inner conductor of a SubMiniature version A (SMA) connector that can be directly connected to a coaxial line thereby providing a simple feed network for the antenna.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any publication is referred to herein, such reference does not constitute an admission that the publication forms prior art or a part of the common general knowledge in the art.

The invention claimed is:

1. An elliptically polarized dielectric block antenna comprising:

a linearly polarized dielectric block antenna; and a wave polarizer integrated with the linearly polarized dielectric block antenna, wherein the wave polarizer converts the linearly polarized wave of the linearly polarized dielectric block antenna into an elliptically polarized wave;

wherein the wave polarizer is integrated with the dielectric block of the linearly polarized dielectric block antenna; and wherein the wave polarizer comprises one or more slots formed in the dielectric block of the linearly polarized dielectric block antenna, each of said one or more slots being arranged at an oblique angle to the direction of polarization of said linearly polarized dielectric block antenna.

2. The elliptically polarized dielectric block antenna of claim 1, wherein the wave polarizer comprises two or more slots formed in the dielectric block of the linearly polarized dielectric block antenna.

3. The elliptically polarized dielectric block antenna of claim 2, wherein said two or more slots formed in the dielectric block of the linearly polarized dielectric block antenna are arranged at different oblique angles to the direction of polarization of said linearly polarized dielectric block antenna.

4. The elliptically polarized dielectric block antenna of claim 2, wherein the wave polarizer comprises a plurality of slots formed in the dielectric block of the linearly polarized dielectric block antenna, each slot formed in a respective face of said dielectric block.

5. The elliptically polarized dielectric block antenna of claim 4, wherein the plurality of slots are formed in respective side faces of the dielectric block at an oblique angle to an axis passing through a remaining two unslotted faces of the dielectric block, said axis being parallel with the direction of polarization of the linearly polarized dielectric block antenna.

6. The elliptically polarized dielectric block antenna of claim 4, wherein each of the plurality of slots extends fully across its respective face of the dielectric block.

7. The elliptically polarized dielectric block antenna of claim 4, wherein the dielectric block comprises a cuboid block of dielectric material.

8. The elliptically polarized dielectric block antenna of claim 7, wherein the wave polarizer comprises four slots formed in the dielectric block, said four slots formed in respective side faces of the cuboid block at an oblique angle to an axis passing through a remaining two unslotted faces of the cuboid block, said axis being parallel with the direction of polarization of the linearly polarized dielectric block antenna.

9. The elliptically polarized dielectric block antenna of claim 1, further comprising a connector which mounts a probe for feeding the dielectric block, said probe extending into said block and being received generally centrally of the dielectric block.

10. The elliptically polarized dielectric block antenna of claim 9, wherein a flange of said connector comprises a ground plane of the antenna, said flange having an area substantially less than an area of a face of the dielectric block adjacent to which said flange is positioned.

11. The elliptically polarized dielectric block antenna of claim 10, wherein said probe extends into a cavity inside said dielectric block.

12. The elliptically polarized dielectric block antenna of claim 11, wherein said cavity is substantially larger than said probe whereby an air gap exists between the probe and an inner surface of the dielectric block defining the cavity.

13. The elliptically polarized dielectric block antenna of claim 11, further comprising a parasitic patch located adjacent a face of the dielectric block opposing the face adjacent which is located the ground plane.

14. The elliptically polarized dielectric block antenna of claim 1, further comprising a parasitic strip located in at least one of said one or more slots.

* * * * *